US006827635B2

(12) United States Patent
Lahnor et al.

(10) Patent No.: US 6,827,635 B2
(45) Date of Patent: Dec. 7, 2004

(54) METHOD OF PLANARIZING SUBSTRATES

(75) Inventors: Peter Lahnor, Dresden (DE); Olaf Kuehn, Dresden (DE); Andreas Roemer, Dresden (DE); Alexander Simpson, Warrenville, IL (US)

(73) Assignee: Infineon Technologies Aktiengesellschaft, Munich (DE)

( * ) Notice: Subject to any disclaimer, the term of this patent is extended or adjusted under 35 U.S.C. 154(b) by 0 days.

(21) Appl. No.: 10/248,949

(22) Filed: Mar. 5, 2003

(65) Prior Publication Data

US 2004/0185756 A1 Sep. 23, 2004

(51) Int. Cl.[7] ..... B24B 1/00

(52) U.S. Cl. ..... 451/57; 451/36; 451/37; 451/41; 451/54; 451/305; 451/443; 451/493

(58) Field of Search ..... 451/36, 37, 41, 451/54, 56, 57, 45, 50, 65, 72, 305, 306, 307, 443, 495, 491, 493

(56) References Cited

U.S. PATENT DOCUMENTS 5,902,173 A * 5/1999 Tanaka ..... 451/56
6,135,868 A * 10/2000 Brown et al. ..... 451/443
6,241,585 B1 * 6/2001 White ..... 451/41
6,361,411 B1 * 3/2002 Chopra et al. ..... 451/56
6,394,883 B1 * 5/2002 Carlson et al. ..... 451/66
6,464,824 B1 * 10/2002 Hofmann et al. ..... 156/345.16
6,547,651 B1 * 4/2003 Boyd et al. ..... 451/285
6,572,440 B2 * 6/2003 Moore ..... 451/5

* cited by examiner

*Primary Examiner*—Joseph J. Hail, III
*Assistant Examiner*—Alvin J Grant
(74) *Attorney, Agent, or Firm*—Slater & Matsil, L.L.P.

(57) ABSTRACT

A method and apparatus of planarizing substrates is disclosed. A planarizing web medium is prepared for planarizing substrates to reduce defect generation. The planarizing web has a planarizing region and preparing region defined thereon, wherein at least one portion of the preparing region is outside the planarizing region. The web medium is advanced to move one portion of the web out of the planarizing region and another portion into the planarizing region.

35 Claims, 6 Drawing Sheets

METHOD OF PLANARIZING SUBSTRATES

BACKGROUND OF INVENTION

Mechanical or chemical-mechanical planarizing processes (CMP) are used to form a substantially flat surface on microelectronic substrates such as semiconductor wafers used in the fabrication of semiconductor devices. FIG. 1 shows a planarizing apparatus 100 comprising a planarizing medium 102 stretched over a platen 104 and a substrate holder 106 that holds the substrate 108. The substrate holder presses the substrate against the planarizing medium, translates and/or rotates it to planarize the substrate. The platen having the planarizing medium thereon may also be rotated relative to the substrate during planarization.

The planarizing medium comprises, for example, a fixed abrasive web. A fixed abrasive comprises abrasive particles embedded within a suspension medium. In one embodiment, the planarizing apparatus has a plurality of rollers to supply, guide and collect the web-format planarizing medium. The rollers include a supply roller 110 to supply fresh or un-used portions of the web and a take-up roller 112 to collect worn or used portions of the web. The web is advanced across the platen such that a fresh portion of the web is introduced into the planarizing region 114 and a worn portion of the web is collected at the take-up roller 112.

One problem associated with fixed abrasive planarizing processes is that the introduction of fresh planarizing material may generate defects on the surface of the substrate. Prior to usage, the surface of fresh planarizing material comprises a highly non-uniform surface topography that may introduce defects such as scratches or gouges on the substrates. The non-uniformity of the planarizing material surface also leads to high unpredictability in the rate at which material is removed from the surface of the substrate. Additionally, the upper surfaces of the posts on the fresh portions of the web are very small, leading to high local pressures between the posts and the substrate which result in scratches and indentations on the substrate. The high rate of defect generation disadvantageously results In loss of yield of operable devices or dies that can be cut or formed from the substrates and lowers the efficiency of the fabrication process.

Hence, it Is desirable to provide a method to prepare the surface of the planarizing web material for use in chemical mechanical planarization processes, in order to increase the efficiency and yield of the manufacturing process.

SUMMARY OF INVENTION

The present invention relates to planarization of microelectronic substrates. More particularly, the invention relates to a method and apparatus of preparing web media for planarizing substrates. In accordance with the invention, a planarizing web having a planarizing region and preparing region defined thereon is provided, wherein at least one portion of the preparing region is outside the planarizing region. In one embodiment, the preparing region is outside the planarizing region. In another embodiment, the outer portion of the preparing region is outside the planarizing region. The planarizing web Is advanced to move one portion of the web out of the planarizing region and another portion of the web into the planarizing region to replace the worn portion.

DETAILED DESCRIPTION

Figure 1:
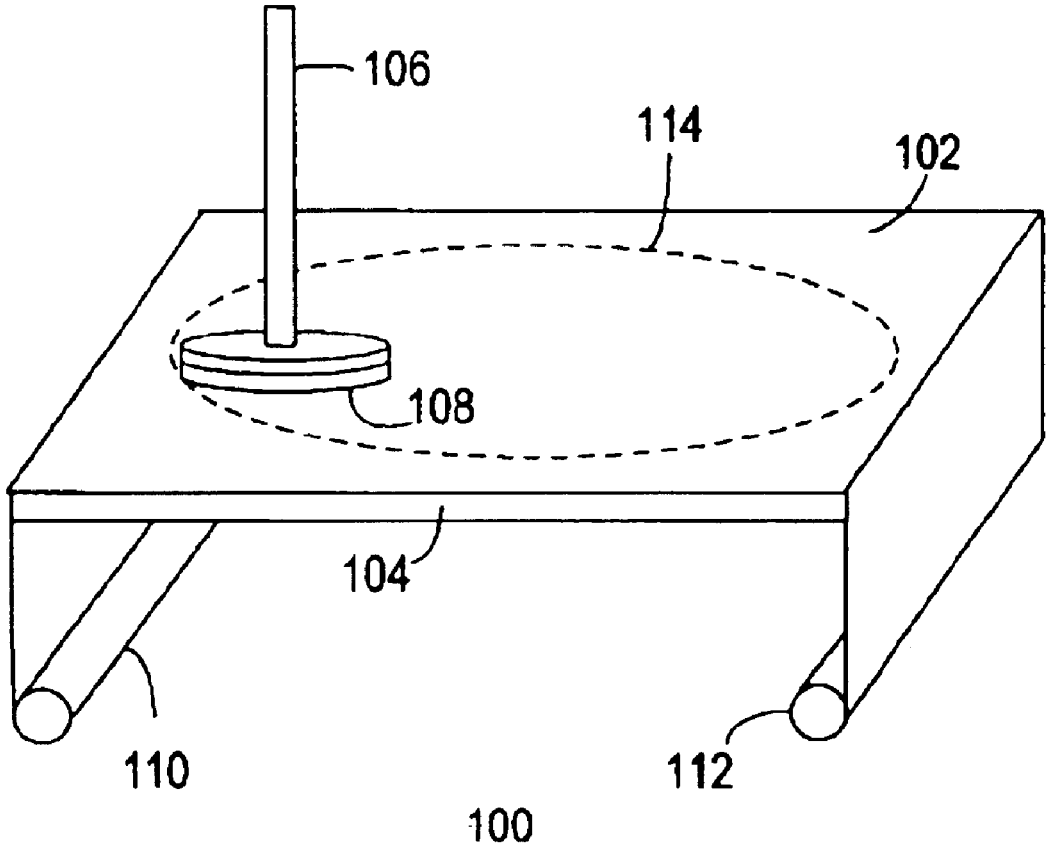
FIG 1 prior art
FIG. 1 shows a conventional planarizing apparatus.
Figure 2:
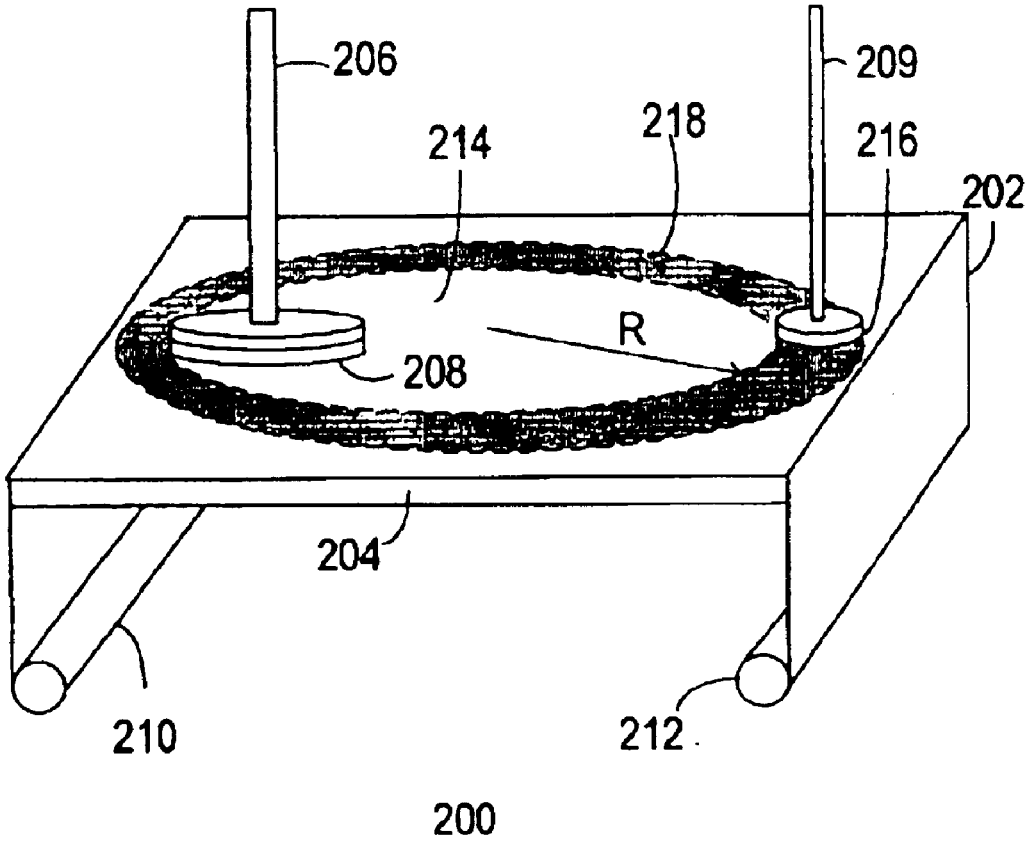
FIG. 2 shows a planarizing apparatus In accordance with one embodiment of the invention.

FIG. 2 shows a schematic view of a planarizing apparatus 200 in accordance with one embodiment of the invention. In one embodiment, the planarizing apparatus comprises a planarizing web medium 202 supported by a platen 204, a substrate holder 206 for holding a substrate 208 and a preparing member 209. The planarizing medium preferably comprises a fixed abrasive, having abrasive particles embedded in a suspension medium. The abrasive particles are used to wear down or planarize the surface of a substrate, and comprise, for example, zirconia, silica, ceria, alumina, sand, diamond or a combination thereof. The suspension medium comprises, for example a polymer material such as resin. Other types of abrasive particles and/or suspension media are also useful.

In one embodiment, the planarizing medium comprises a long flexible web. In one embodiment, the web material is guided, positioned and held in place over the platen using a plurality of rollers. The rollers include, for example, a supply roller 210 and a take-up roller 212. Additional rollers may also be included to guide and position the web material. The fresh or un-used portion of the web Is supplied by the supply roller and the worn or used portion of the web is collected by the take-up roller.

The planarizing web has a planarizing region 214 and a preparing region 218 defined thereon. To planarize the substrate, the substrate holder presses the substrate against a surface of the planarizing medium. The substrate is moved across the surface of the planarizing medium within a planarizing region 214 during a planarization phase. The planarizing region, In one embodiment, is circular. The planarizing region may comprise other irregular or regular shapes, such as a rectangular shape or a square shape.

In one embodiment, the substrate is rotated in a clockwise direction within the planarizing web. Rotating the substrate in a counter clockwise direction is also useful.

The radius R of the planarizing region is, for example greater than the diameter of the substrate. Providing a radius R which is equal to or less than the diameter of the substrate is also useful. In addition, the substrate itself can also be rotated, for example, in a clockwise direction while it is being rotated in the planarizing region. Rotating the substrate in a counter clockwise direction is also useful.

The abrasive particles in the planarizing medium serve to abrade material from the surface of the substrate. The planarizing web is advanced or moved in incremental steps across the platen, so as to move one portion of the planarizing web out of the planarizing region and another portion of the planarizing web into the planarizing region, to replace the worn portions of the web.

Figure 3A:
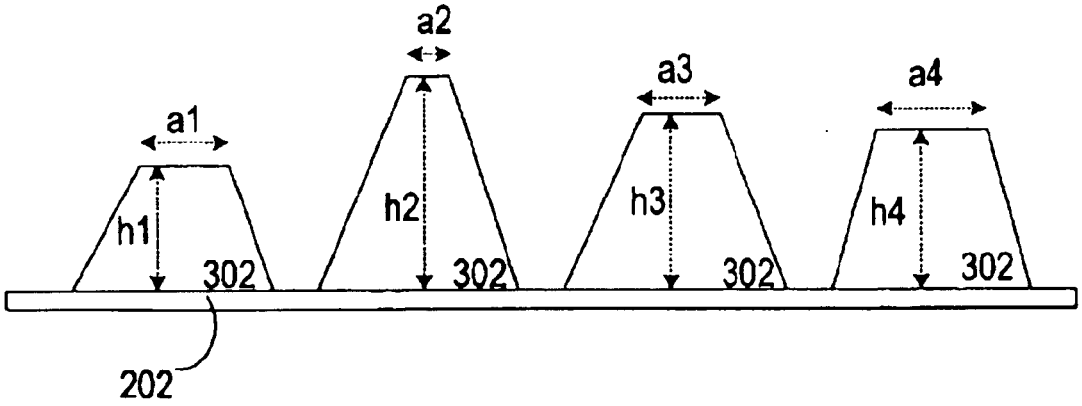
FIGS. 3*a* and 3*b* show the planarizing web before and after preparation respectively.

A preparing member 209 is provided to prepare the planarizing medium forplanarizing the substrate, since web posts of fresh planarizing medium comprise large deviations In dimensions, such as height and surface area. FIG. 3*a* shows one example of a fresh portion of an abrasive web surface 202 before preparation. The varying heights (e.g. h1–h4) create a highly non-uniform topography that may cause defects on the surface of the substrate during planarization. Small upper surface area (e.g. a2) leads to high local pressures between the posts and the substrate that disadvantageously result in the formation of scratches and indentations on the substrate. This causes the polishing rate to be highly unpredictable and results in the loss of yield of operable devices or dies that can be cut or formed from the substrates.

Figure 3B:
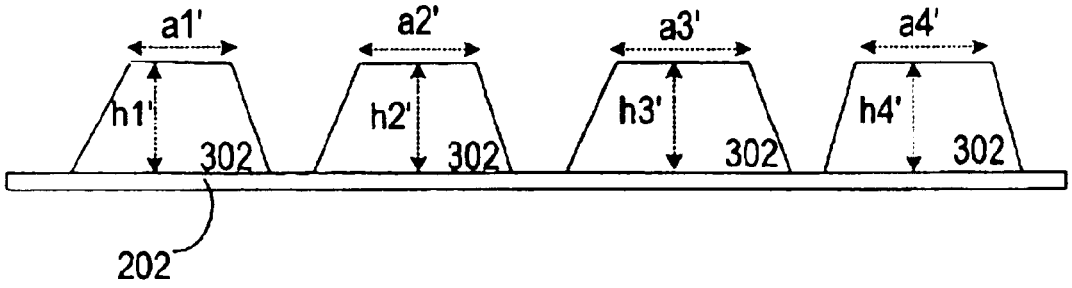

In one embodiment of the invention, the web surface is prepared to remove the upper portions of the web posts. Referring to FIG. 3*b*, the heights of the web posts 302 are normalized to about the same after preparation, hence stabilizing the polishing rate and reducing the rate of defect generation.

Referring back to FIG. 2, the preparing member includes a preparing disk 216. The preparing disk is pressed on the web and moved in a preparing region 218 during a preparation phase, wherein at least one portion of the preparing region is outside the planarizing region. In one embodiment, the preparing region is outside the planarizing region, as shown in FIG. 2. By preparing the region outside the planarizing region, the web may be prepared concurrently with the planarization of the substrate, thus increasing productivity. In one embodiment, the preparation phase is provided before the planarization phase of each substrate. Alternatively, the preparation phase may be provided during the planarization phase or after the planarization phase of the substrate, in preparation for the next substrates to be planarized.

The preparing disk comprises, for example, glass, silicon oxide or diamond particles attached to a plate, or a combination thereof. Other types of suitable materials are also useful. The preparing disk may include structures like line or space patterns to simulate the surface of actual substrates. Other types of suitable structures and shapes are also useful. Preferably, the size of the preparing disk does not increase the width of the web and web platen too much. The size of the preparing disk is also preferably larger than the width of the web's incremental steps to make sure that fresh web material is prepared before it is moved into the planarization region. In one embodiment, the diameter of the preparing disk is about 1 to 5 inches. Other suitable sizes are also useful.

Figure 4:
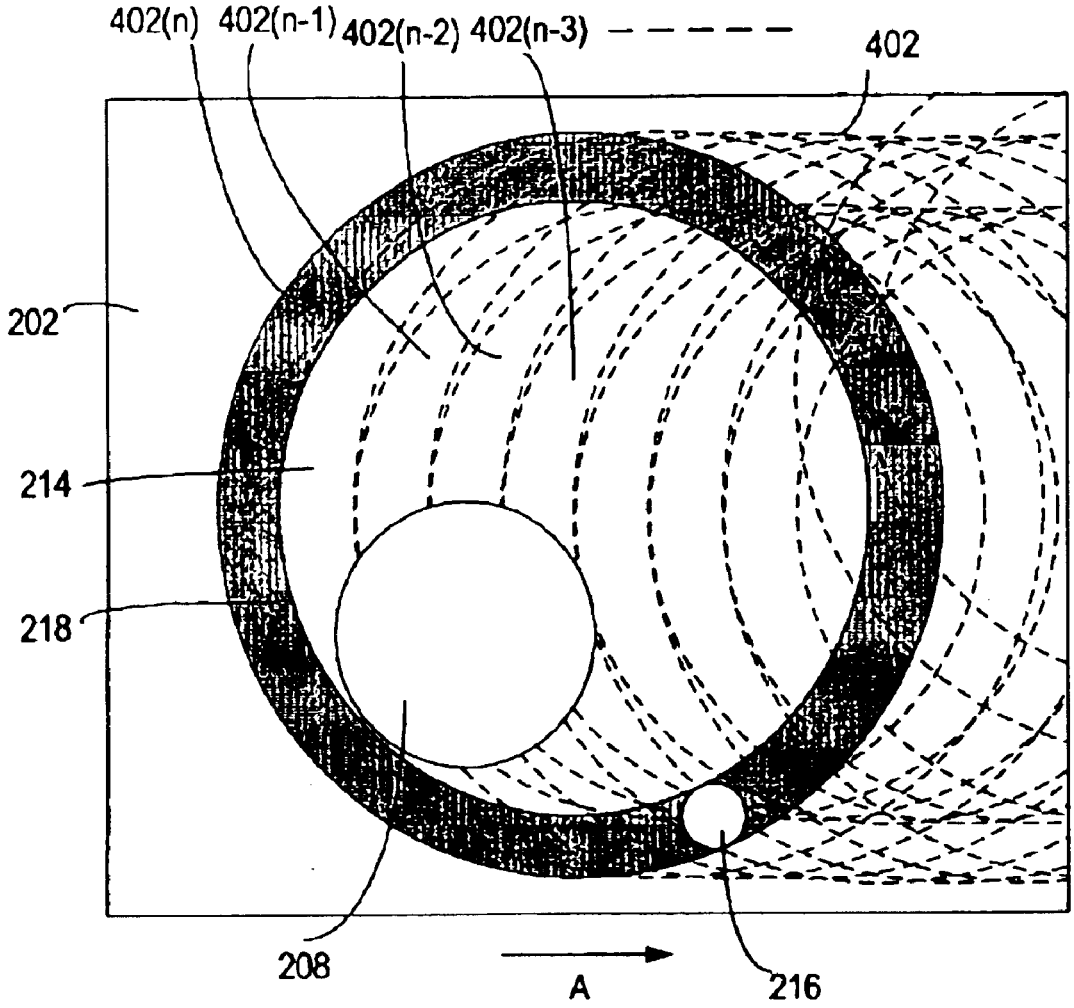
FIG. 4 shows the footprints generated by a preparing disk over time, in accordance with one embodiment of the invention.

FIG. 4 shows the footprints 402 generated by the preparing disk over time, in accordance with one embodiment of the invention. For example, the footprint indicated by the shaded region 402(n) is generated by the preparing disk at current time n. The footprints (e.g., 402(n−1), 402(n−2) and 402(n−3)) indicated by the dotted lines are generated by the preparing disk 216 at previous times during previous preparation phases. The web is advanced in, for example, direction A, causing footprints generated during previous preparation phases to overlap the planarizing region 214 for the substrate 208. Moving the web in other directions is also useful.

Hence, the planarizing region is prepared during previous preparation phases.

Figure 5:
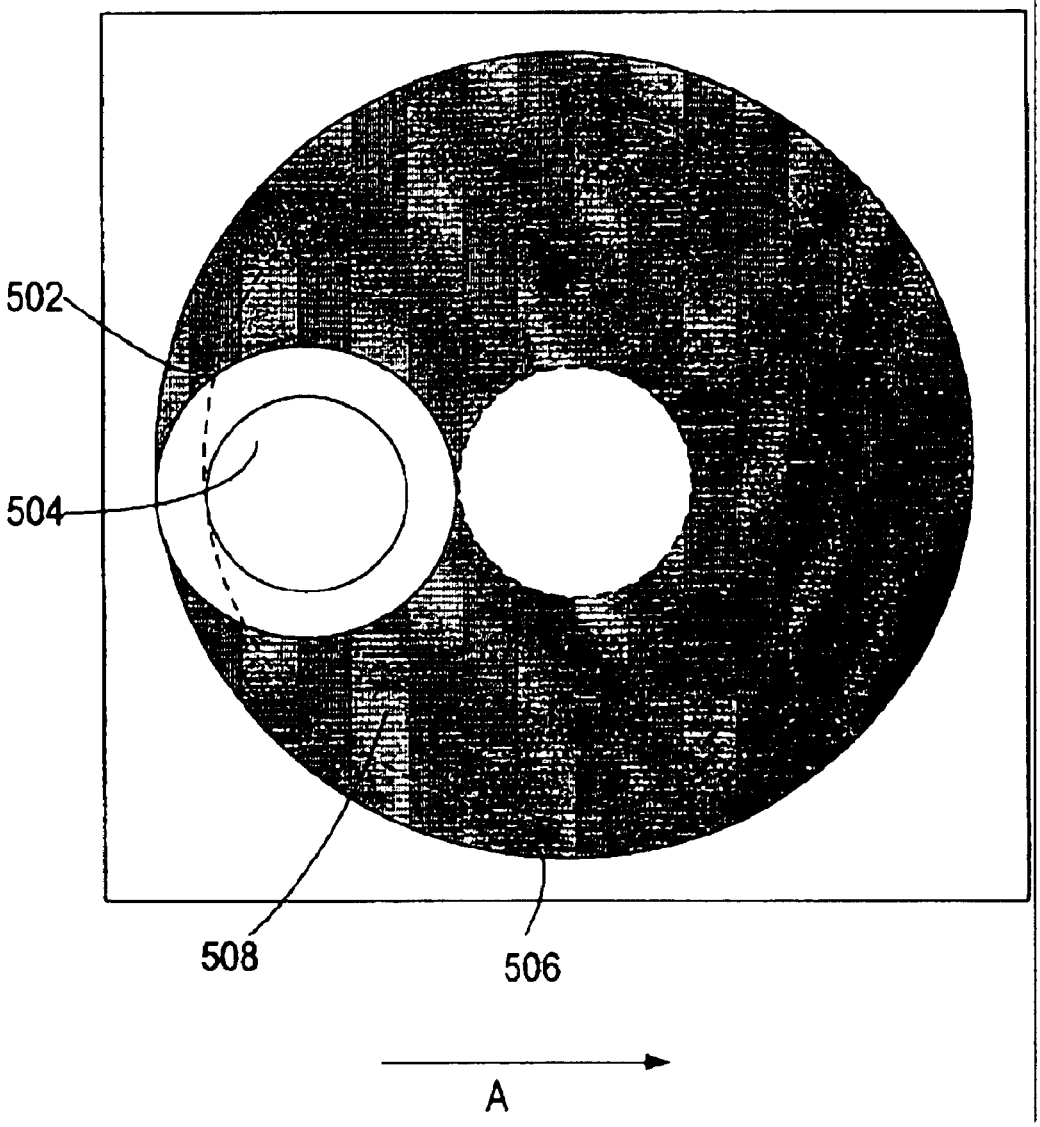
FIG. 5 shows a planar view of a planarizing apparatus in accordance with another embodiment of the invention.

FIG. 5 shows the planar view of another embodiment in accordance with the invention. The preparing member comprises a retainer ring 502. The retainer ring may be provided as part of the substrate holder for holding the substrate 504. The retainer ring may comprise glass, silicon oxide or diamond particles attached or embedded therein, or a combination thereof. Other types of suitable materials are also useful. The retainer ring may also include structures like line or space patterns to simulate the surface of actual substrates. Other types of suitable structures and shapes are also useful.

The substrate is moved within the planarizing region 508 during the planarization phase, wherein the planarizing region is delineated by dashed lines. During the preparation phase, the retainer ring is brought in contact with the web surface and moved within a preparing region 506, indicated by the shaded region. In one embodiment, the retainer ring Is brought in contact with the web surface, while the substrate is lifted from the web surface during the preparation phase. Alternatively, the retainer ring is brought in contact with the web surface while the substrate contacts the web surface with low pressure. Preferably, the preparation phase is provided before the planarization phase. Alternatively, the preparation phase is provided after the planarization phase, In preparation for the next substrates to be planarized.

As shown in FIG. 5, the outer portion of the preparing region is outside the planarizing region. The footprints generated by the retainer ring at previous times during previous preparation phases overlap the planarizing region 508 as the web advances along, for example, direction A.

While the invention has been particularly shown and described with reference to various embodiments, it will be recognized by those skilled in the art that modifications and changes may be made to the present invention without departing from the spirit and scope thereof. The scope of the invention should therefore be determined not with reference to the above description but with reference to the appended claims along with their full scope of equivalents.

What is claimed is:

1. A method of planarizing substrates comprising:

providing a planarizing web having a planarizing region and a preparing region defined thereon, wherein at least one portion of the preparing region is outside the planarizing region;

moving a substrate within the planarizing region during a planarization phase;

moving a preparing member within the preparing region during a preparation phase; and advancing one portion of the planarizing web out of the planarizing region and another portion of the planarizing web into the planarizing region.

2. The method of claim 1 wherein the preparing region is entirely outside the planarizing region.

3. The method of claim 1 and further comprising advancing a third portion of the planarizing web out of the preparing region and into the planarizing region.

4. The method of claim 1 wherein advancing another portion of the planarizing web into the planarizing region comprises advancing the another portion from the preparing region into the planarizing region.

5. The method of claim 1 wherein one portion of the planarizing web comprises linearly moving the planarizing web.

6. The method of claim 1 wherein the preparing member comprises a preparing disk.

7. The method of claim 6 wherein the preparation phase is provided before the planarization phase.

8. The method of claim 6 wherein the preparation phase is provided after the planarization phase.

9. The method of claim 6 wherein the preparation phase is provided during the planarization phase.

10. The method of claim 1 wherein the preparing member comprises a retainer ring.

11. The method of claim 10 wherein the outer portion of the preparing region is outside the planarizing region.

12. A method of planarizing substrates comprising:

providing a planarizing web having a planarizing region and a preparing region defined thereon, wherein at least one portion of the preparing region is outside the planarizing region, wherein the planarizing web comprises a fixed abrasive;

moving a substrate within the planarizing region during a planarization phase;

moving a preparing member within the preparing region during a preparation phase; and advancing one portion of the planarizing web out of the planarizing region and another portion of the planarizing web into the planarizing region.

13. The method of claim 12 wherein the preparing region is outside the planarizing region.

14. The method of claim 13 wherein the preparing member comprises a preparing disk.

15. The method of claim 14 wherein the planarizing region comprises a regular shape.

16. The method of claim 15 wherein the planarizing region comprises a circular shape, a rectangular shape or a square shape.

17. The method of claim 14 wherein the planarizing region comprises an irregular shape.

18. A method of planarizing substrates comprising:

providing a planarizing web having a planarizing region and a preparing region defined thereon, wherein at least one portion of the preparing region is outside the planarizing region, wherein the preparing region is entirely outside the planarizing region;

moving a substrate within the planarizing region during a planarizing phase;

moving a preparing member within the preparing region during a preparation phase; and advancing one portion of tho planarizing web out of the planarizing region and another portion of the planarizing web into the planarizing region.

19. The method of claim 18 wherein the preparing member comprises a preparing disk.

20. The method of claim 19 wherein the planarizing region comprises a regular shape.

21. The method of claim 20 wherein the planarizing region comprises a circular shape a rectangular shape or a square shape.

22. The method of claim 19 wherein the planarizing region comprises an irregular shape.

23. An apparatus for planarizing substrates comprising:

a planarizing web having a planarizing region and a preparing region defined thereon, wherein at least one portion of the preparing region is outside the planarizing region;

a platen supporting the planarizing web, the planarizing web being movable across the platen to move one portion of the planarizing web out of the planarizing region end another portion of the planarizing web into the planarizing region;

a substrate holder for pressing a substrate against the planarizing web and moving the substrate within a planarizing region; and a preparing member being movable within the preparing region for preparing the planarizing web.

24. The apparatus of claim 23 wherein the preparing member comprise a preparing disk.

25. The apparatus of claim 23 wherein the preparing region is outside the planarizing region.

26. The apparatus of claim 25 wherein the preparing member comprises a preparing disk.

27. The apparatus of claim 25 wherein the preparing region is outside the planarizing region.

28. The apparatus of claim 26 wherein the preparing member comprises a material attacked to a plate, the material comprising glass, silicon oxide or diamond particles, or a combination thereof.

29. The apparatus of claim 28 wherein the preparing member comprises line or space patterns.

30. The apparatus of claim 23 wherein the outer portion of the preparing region is outside the planarizing region.

31. The apparatus of claim 30 wherein the preparing member comprises a retainer ring.

32. The apparatus of claim 31 wherein the retainer ring is provided as part of the substrate holder.

33. The apparatus of claim 23 wherein the substrate holder comprises a substrate holder for rotatably moving the substrate within the planarizing region and where the planarizing web is linearly moveable across the platen.

34. The apparatus of claim 33 wherein the preparing member is rotatably moveable within the preparing area.

35. The apparatus of claim 33 wherein the substrate holder is for moving the substrate circularly within the planarizing region.

* * * * *

UNITED STATES PATENT AND TRADEMARK OFFICE

CERTIFICATE OF CORRECTION

PATENT NO. : 6,827,635 B2
DATED : December 7, 2004
INVENTOR(S) : Lahnor et al.

It is certified that error appears in the above-identified patent and that said Letters Patent is hereby corrected as shown below:

Column 5,
Line 35, delete "planarizing" and insert -- planarization --
Line 38, delete "tho" and insert -- the --
Line 46, insert a comma after the first occurrence of "shape"

Column 6,
Line 19, delete "comprise" and insert -- comprises --
Line 27, delete "attacked" and insert -- attached --

Signed and Sealed this

Twelfth Day of July, 2005

JON W. DUDAS
*Director of the United States Patent and Trademark Office*